US008474940B2

(12) United States Patent
Samoto

(10) Patent No.: US 8,474,940 B2
(45) Date of Patent: Jul. 2, 2013

(54) IMAGE RECORDING APPARATUS AND IMAGE RECORDING METHOD

(75) Inventor: Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 191 days.

(21) Appl. No.: 13/004,870

(22) Filed: Jan. 11, 2011

(65) Prior Publication Data

US 2011/0181649 A1 Jul. 28, 2011

(30) Foreign Application Priority Data

Jan. 28, 2010 (JP) ..... 2010-017121

(51) Int. Cl.
*B41J 29/38* (2006.01)

(52) U.S. Cl.
USPC ..... 347/16

(58) Field of Classification Search
USPC ..... 347/16
See application file for complete search history.

(56) References Cited

FOREIGN PATENT DOCUMENTS

| | | | | |
|---|---|---|---|---|
| JP | 2001-232882 | A | | 8/2001 |
| JP | 3094119 | U | | 6/2003 |
| JP | 2004-306376 | A | | 11/2004 |
| JP | 2006-082410 | A | | 3/2006 |
| JP | 2007-168259 | A | | 7/2007 |
| JP | 2007168259 | | * | 7/2007 |
| JP | 2008-062607 | A | | 3/2008 |

* cited by examiner

*Primary Examiner* — Uyen Chau N Le
*Assistant Examiner* — Kajli Prince
(74) *Attorney, Agent, or Firm* — Baker Botts L.L.P.

(57) ABSTRACT

An image recording apparatus including: a controller including a position storing section storing a first position which is a position of a recording portion at a point in time earlier by a rotation required period than a point in time when the recording portion is positioned at a second position at which ejection of liquid droplets has been completed, the rotation required period being a period from a point in time when a drive command is outputted to a second motor for rotating a feeding roller to a point in time when an amount of the rotation of the feeding roller reaches a preset threshold amount; and a drive command outputting section configured to output the drive command to the second motor when the position of the recording portion has reached the first position.

12 Claims, 8 Drawing Sheets

IMAGE RECORDING APPARATUS AND IMAGE RECORDING METHOD

CROSS REFERENCE TO RELATED APPLICATION

The present application claims priority from Japanese Patent Application No. 2010-017121, which was filed on Jan. 28, 2010, the disclosure of which is herein incorporated by reference in its entirety.

BACKGROUND OF THE INVENTION

1. Field of the Invention

The present invention relates to an image recording apparatus and an image recording method for recording an image on a recording medium.

2. Description of the Related Art

There is conventionally known an image recording apparatus configured to eject ink droplets to perform an image recording on a recording medium. The image recording apparatus of this type is generally called an ink-jet printer. The image recording of the ink-jet printer is performed by ejection of the ink from nozzles.

In the image recording on the recording medium by the ink-jet printer, recording operations and feeding operations are alternately performed. In the recording operation, a recording portion having nozzles formed therein ejects ink droplets from the nozzles onto a recording medium while moving in a direction intersecting a feeding direction of the recording medium. In the feeding operation, a feeding roller feeds or conveys the recording medium in the feeding direction by a predetermined amount (distance).

In order to perform the image recording in a short time, the ink-jet printer may be configured such that an acceleration of the feeding roller performed at a first stage of the feeding operation and a deceleration of the recording portion performed at a last stage of the recording operation are performed at the same time. This shortens a processing time of the image recording.

As the ink-jet printer of the above-described type, there is an ink-jet printer configured to generate a drive command of a sheet-feed motor upon a completion of a recording by a recording portion as a trigger, thereby driving a feeding roller to start a feeding operation of a recording sheet, for example.

In the image recording apparatus and the image recording method as described above, it is possible to shorten a length of time required for the image recording while eliminating an effect of a delay from the point when the drive command has been outputted to the second motor to the point when the feeding roller has actually started to be rotated.

SUMMARY OF THE INVENTION

However, a delay may be caused after the drive command for driving the feeding roller has been outputted by a controller of the ink-jet printer and before the feeding roller has actually started to be rotated. The delay may be caused by mechanism problems and/or software problems. For example, where a drive-power transmitting mechanism constituted by gears is provided between a drive source such as a motor for driving the feeding roller and the feeding motor, a delay is caused in a transmission of a drive power from the motor to the feeding roller. Further, a delay may be caused by a software during a transmission of the drive command to the motor.

The present invention has been developed in view of the above-described situations, and it is an object of the present invention to provide an image recording apparatus and an image recording method which can shorten a length of time required for an image recording by eliminating an affect of a delay from an output of a drive command to a feeding roller to a point when the feeding roller has actually rotated.

The object indicated above may be achieved according to the present invention which provides an image recording apparatus comprising: a recording portion configured to eject liquid droplets to record an image on a recording medium while being moved in a second direction intersecting a first direction in which the recording medium is fed; a feeding roller configured to feed the recording medium toward the recording portion; a first detecting portion configured to detect a position and a velocity of the recording portion in the second direction; a second detecting portion configured to detect a rotation amount of the feeding roller; a first motor configured to move the recording portion; a second motor configured to rotate the feeding roller; and a controller configured to control the movement of the recording portion by outputting a drive command to the first motor and configured to control the rotation of the feeding roller by outputting a drive command to the second motor, the controller including: a position storing section configured to store a first position which is a position of the recording portion, in a single movement of the recording portion, at a point in time earlier by a rotation required period than a point in time when the recording portion is positioned at a second position at which the ejection of the liquid droplets has been completed in the single movement of the recording portion, the rotation required period being a period from a point in time when the drive command is outputted to the second motor to a point in time when an amount of the rotation of the feeding roller reaches a preset threshold amount; and a drive command outputting section configured to output the drive command to the second motor when the position of the recording portion which has been detected by the first detecting portion has reached the first position.

The object indicated above may be achieved according to the present invention which provides an image recording method applied to an image recording apparatus including: a recording portion configured to eject liquid droplets to record an image on a recording medium while being moved in a second direction intersecting a first direction in which the recording medium is fed; a feeding roller configured to feed the recording medium toward the recording portion; a first detecting portion configured to detect a position and a velocity of the recording portion in the second direction; a second detecting portion configured to detect a rotation amount of the feeding roller; a first motor configured to move the recording portion; and a second motor configured to rotate the feeding roller, the image recording method comprising: storing a first position which is a position of the recording portion, in a single movement of the recording portion, at a point in time earlier by a rotation required period than a point in time when the recording portion is positioned at a second position at which the ejection of the liquid droplets has been completed in the single movement of the recording portion, the rotation required period being a period from a point in time when the drive command is outputted to the second motor to a point in time when an amount of the rotation of the feeding roller reaches a preset threshold amount; outputting the drive command to the second motor when the position of the recording portion which has been detected by the first detecting portion has reached the first position; and controlling a drive of the second motor on the basis of the drive command to rotate the feeding roller.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DESCRIPTION OF THE EMBODIMENT

Hereinafter, there will be described an embodiment of the present invention by reference to the drawings. It is to be understood that the following embodiment is described only by way of example, and the invention may be otherwise embodied with various modifications without departing from the scope and spirit of the invention.

<Multi-Function Device 1>

Figure 1:
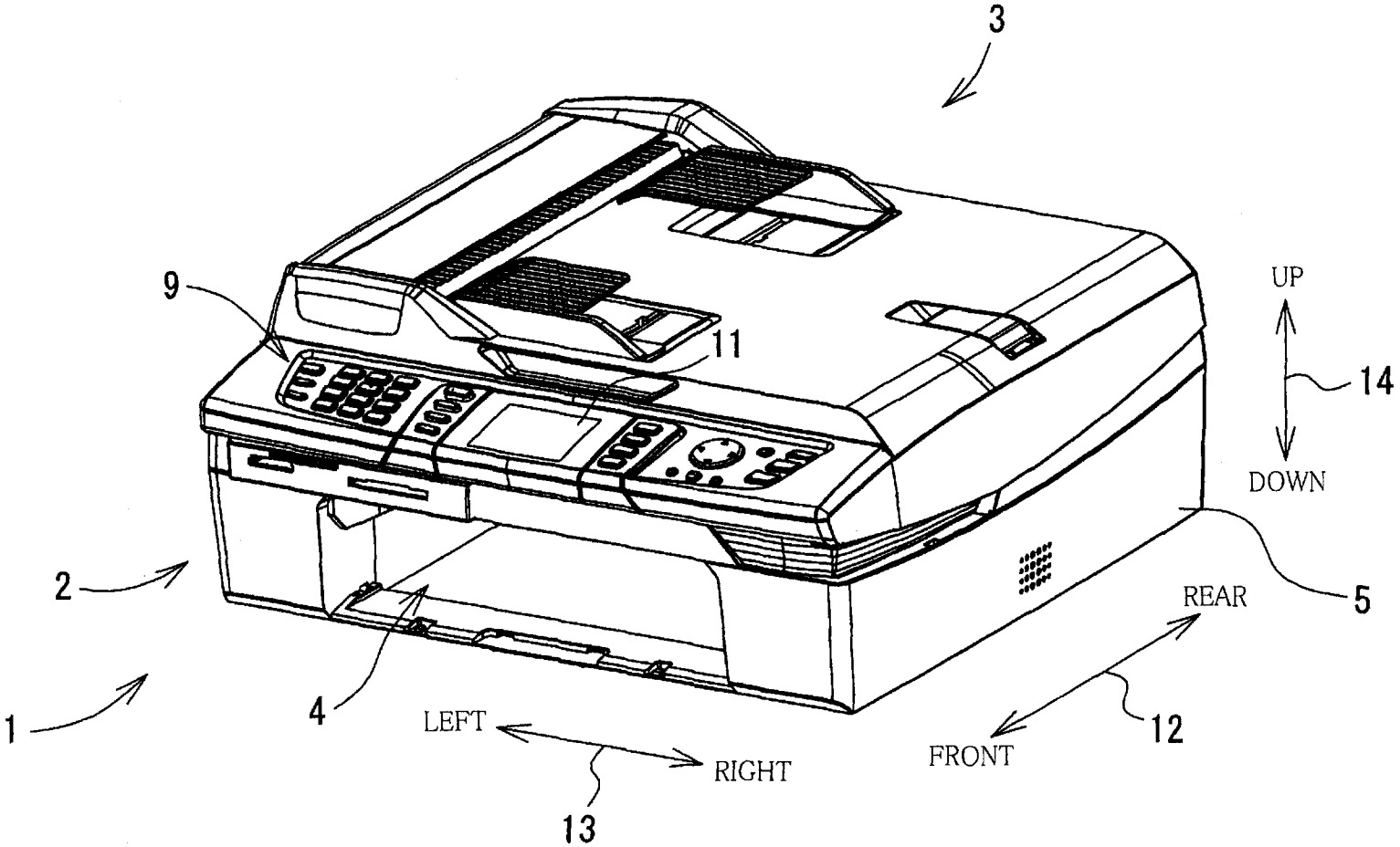
FIG. 1 is an external perspective view showing an MFD 1 as an example of an embodiment of the present invention.

There will be explained an MFD 1 as an example of an image recording apparatus to which the present invention is applied. As shown in FIG. 1, in the present embodiment, a direction indicated by an arrow 13 is defined as a widthwise direction (or a rightward and leftward direction) of the MFD 1, a direction indicated by an arrow 14 is defined as a height direction (or an upward and downward direction) of the MFD 1, and a direction indicated by an arrow 12 is defined as a depth direction (or a frontward and rearward direction) of the MFD 1.

The MFD 1 is a multi-function device which mainly includes a printing section 2 disposed at a lower portion thereof and a scanning section 3 disposed on the printing section 2. The MFD 1 has various functions such as a printing function, a scanning function, a copying function, and a facsimile function.

It is noted that the functions other than the printer function such as the scanning function and the facsimile function are optional, and thus this image recording apparatus may be configured as a printer having only the printing function, for example. Further, the scanning section 3 is an optional component for the present invention, and thus a detailed explanation thereof is dispensed with.

The MFD 1 is used in a state in which the MFD 1 is connected to an external device, not shown, such as a computer. The printing section 2 records or prints an image on a recording medium such as a recording sheet on the basis of recording data received from the external device or image data of a document read or scanned by the scanning section 3.

An operational panel 9 for operating the printing section 2 and the scanning section 3 is provided on an upper front portion of the MFD 1 which is located on a front side of the scanning section 3. The operational panel 9 is constituted by various operational buttons and a liquid crystal display portion 11. The MFD 1 is controlled and operated by a controller 130 (see FIG. 5) on the basis of a command outputted from the operational panel 9 or transmitted from an external device via a printer driver or a scanner driver, for example.

<Printing Section 2>

Hereinafter, there will be explained a structure of the printing section 2 in detail with reference to FIGS. 1 through 4. As shown in FIG. 1, the printing section 2 includes a casing 5 having an opening 4 on its front face. Components of the printing section 2 are disposed in the casing 5.

A sheet-supply tray 20 and a sheet-discharge tray 21 (see FIG. 2) are inserted into or removed from the MFD 1 through the opening 4. It is noted that the sheet-supply tray 20 and the sheet-discharge tray 21 are omitted in FIG. 1. The sheet-supply tray 20 can accommodate thereon recording sheets of various sizes such as an A4 size and a B5 size.

Figure 2:
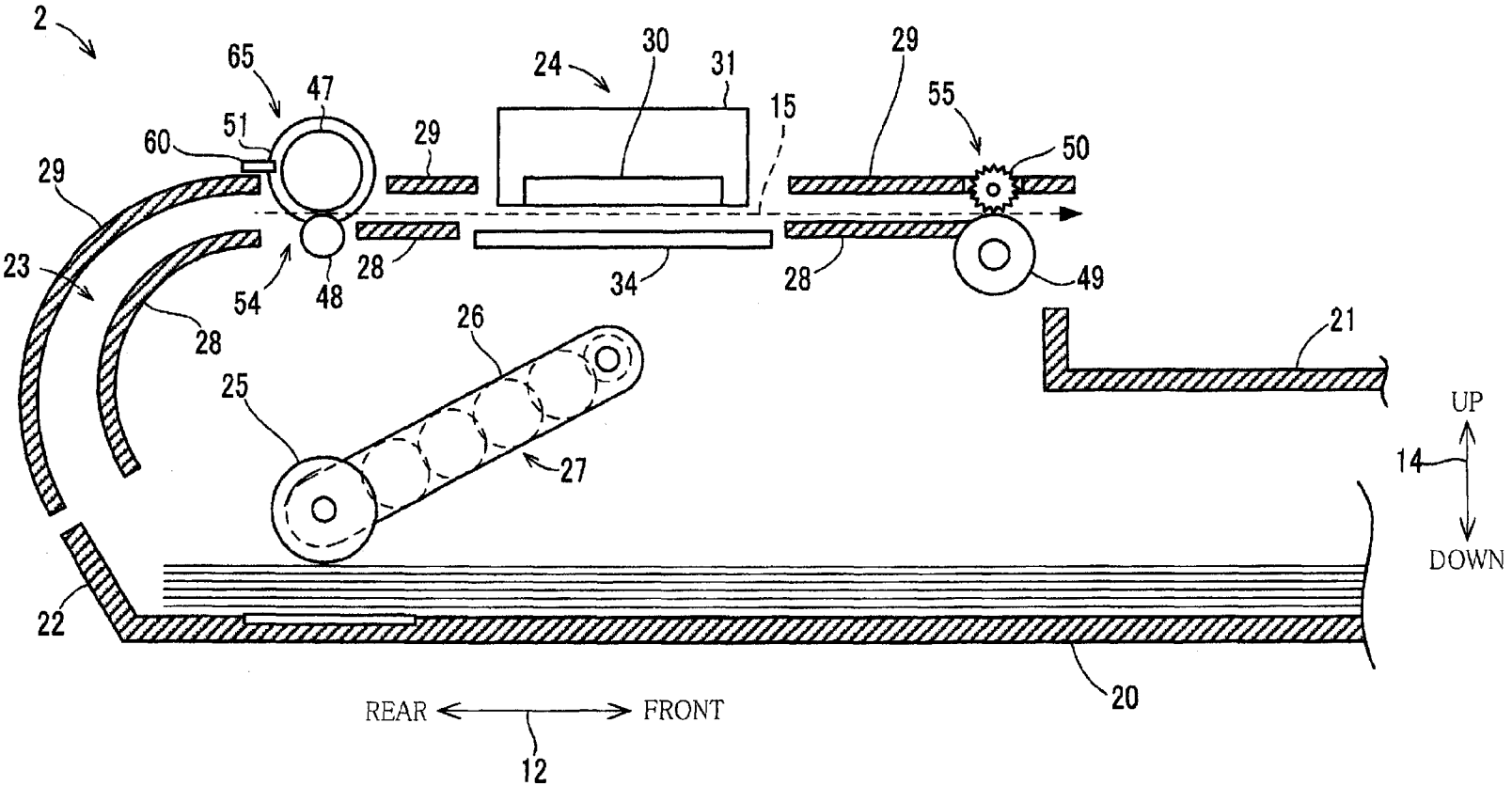
FIG. 2 is an elevational view in vertical cross section schematically showing an internal structure of a printing section 2.

As shown in FIG. 2, when the sheet-supply tray 20 has been mounted on the MFD 1, the recording sheets accommodated on the sheet-supply tray 20 are set such that a longitudinal direction of the recording sheets coincides with the depth direction 12. The sheet-discharge tray 21 is supported by and disposed on the sheet-supply tray 20. The sheet-supply tray 20 and the sheet-discharge tray 21 are mounted on the MFD 1 in a state in which the trays 20, 21 are superposed on each other in a vertical direction.

An inclined sheet-separate plate 22 is disposed on a rear side of the sheet-supply tray 20 mounted on the MFD 1. The inclined sheet-separate plate 22 is for separating the recording sheets supplied from the sheet-supply tray 20 and guiding the separated sheet upward.

A sheet-supply roller 25 is provided above the sheet-supply tray 20. The sheet-supply roller 25 is supported by a lower end portion of a sheet-supply arm 26 pivotable upward and downward so as to be moved toward and away from the sheet-supply tray 20. The sheet-supply roller 25 is rotated by a drive power of a sheet-supply motor 76 (see FIG. 5) which is transmitted by a drive-power transmitting mechanism 27 including a plurality of gears meshed with one another. When the sheet-supply arm 26 is pivoted downward, the sheet-supply roller 25 is brought into pressing contact with an uppermost one of the recording sheets on the sheet-supply tray 20. In this state, the sheet-supply roller 25 is rotated to supply the recording sheet. The supplied recording sheet is brought into contact at its leading end with the inclined sheet-separate plate 22, whereby the recording sheet is reliably separated from the other sheets. The separated recording sheet is guided upward and fed to a sheet-feed path 23.

The sheet-feed path 23 is defined above the inclined sheet-separate plate 22. The sheet-feed path 23 curves upward from a position just above the inclined sheet-separate plate 22 and extends from the rear side to the front side. The sheet-feed path 23 then passes through a nipping position of a pair of sheet-feed rollers 54 constituted by a sheet-feed roller 47 as an example of a feeding roller and a pinch roller 48, a position below an image recording portion 24, and a nipping position of a pair of sheet-discharge rollers 55 constituted by a sheet-discharge roller 49 and a spur roller 50 and reaches the sheet-discharge tray 21. The recording sheet supplied from the sheet-supply tray 20 is guided by the sheet-feed path 23 so as to make an upward U-turn and reach the image recording portion 24. The image recording portion 24 performs an image recording on the recording sheet, and then the recording sheet is discharged to the sheet-discharge tray 21. The sheet-feed path 23 is defined by an inner guide face 28 and an outer guide face 29 facing each other with a specific distance interposed therebetween, except a portion thereof where components such as the image recording portion 24 are disposed.

Here, a direction indicated by broken-line arrow in FIG. 2 is defined as a sheet-feed direction 15 as a first direction. That is, the sheet-feed direction 15 is a direction in which the recording sheet is fed from the nipping position of the pair of sheet-feed rollers 54 to the sheet-discharge tray 21 through the position below the image recording portion 24 and the nipping position of the pair of sheet-discharge rollers 55.

<Image Recording Portion 24>

The image recording portion 24 includes a recording head 30 and a carriage 31. The recording head 30 is mounted on the carriage 31 reciprocable in a main scanning direction as a second direction. Here, the main scanning direction is a direction perpendicular to a sheet surface of FIG. 2, that is, the rightward and leftward direction 13 intersecting the sheet-feed direction 15. The recording head 30 is exposed from a lower face of the carriage 31. Cyan ink (C), magenta ink (M), yellow ink (Y), and black ink (Bk) are respectively supplied from ink tanks, not shown, to the recording head 30 through ink tubes 33 (see FIG. 3).

Figure 3:
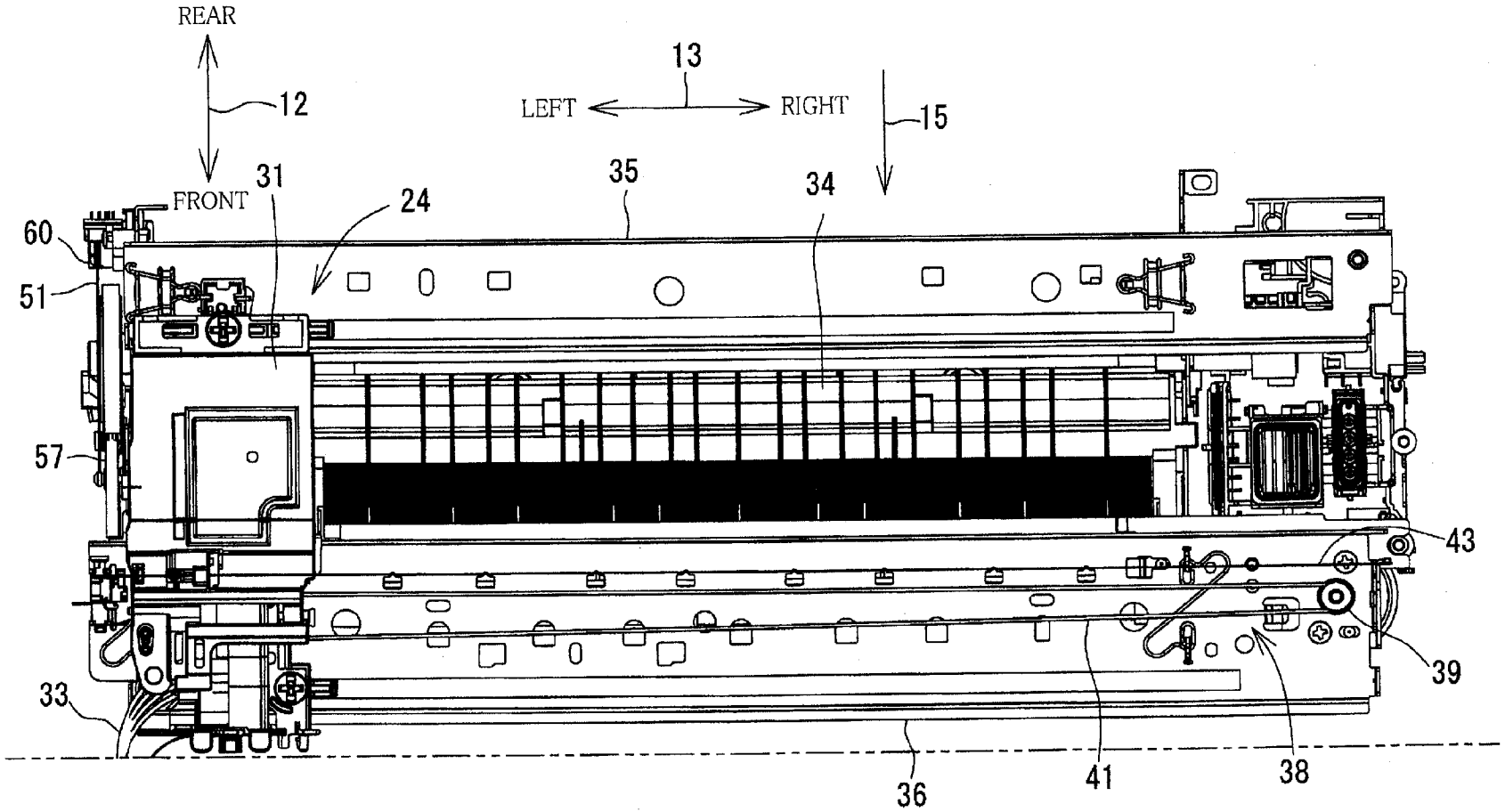
FIG. 3 is a partial plan view showing the internal structure of the printing section 2.
Figure 4:
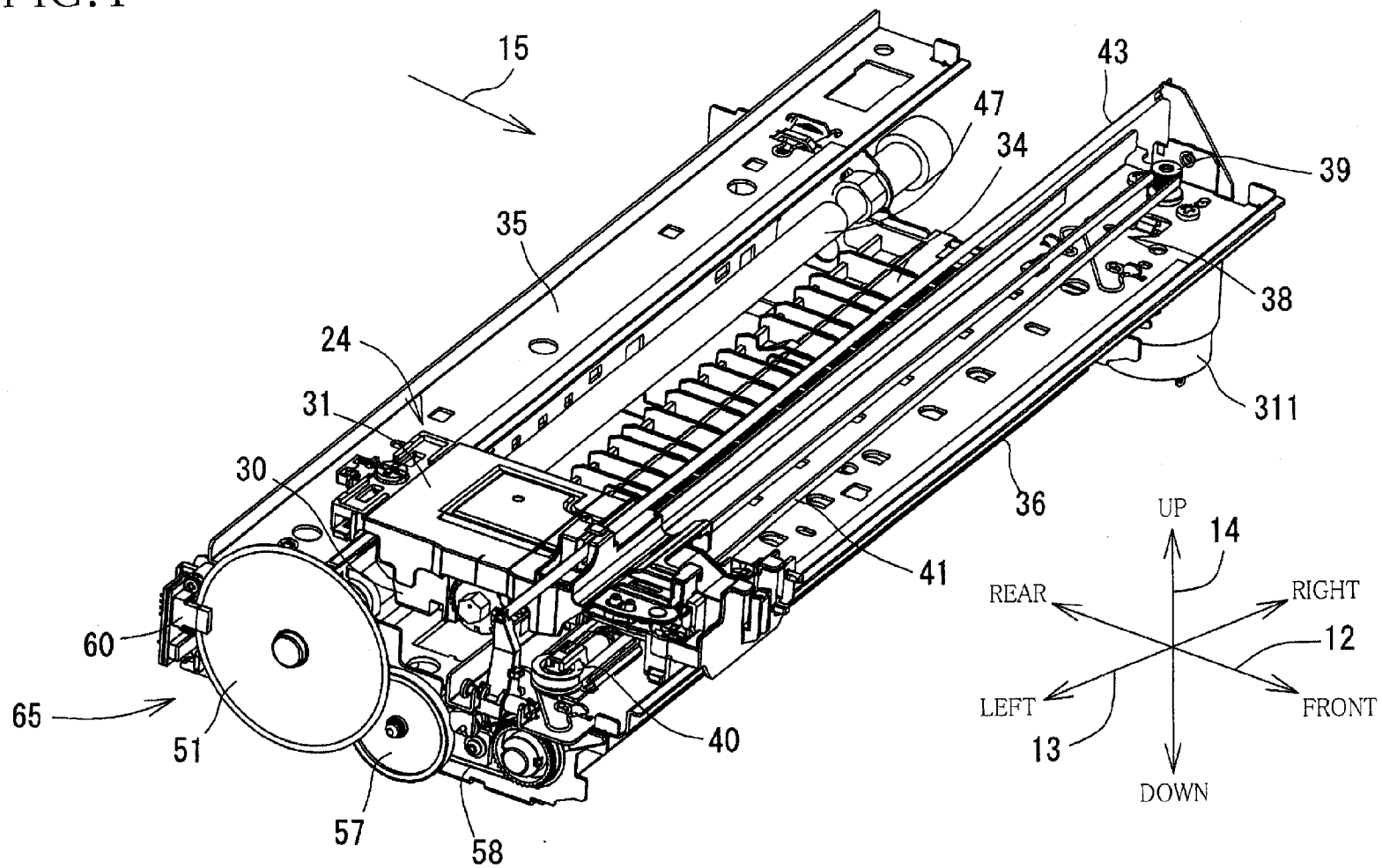
FIG. 4 is a perspective view showing a mechanism of an image recording portion 24.

As shown in FIGS. 3 and 4, a pair of guide rails 35, 36 are disposed above the sheet-feed path 23. The guide rails 35, 36 are distant from each other in the sheet-feed direction 15 and extend in a widthwise direction of the sheet-feed path 23, i.e., the rightward and leftward direction 13. The carriage 31 is mounted on the guide rails 35, 36 so as to bridge the guide rails 35, 36. The carriage 31 is slidable and movable in the rightward and leftward direction 13.

A belt drive mechanism 38 is provided on an upper face of the guide rail 36. The belt drive mechanism 38 includes a drive pulley 39, a driven pulley 40, and a timing belt 41. The drive pulley 39 and the driven pulley 40 are respectively provided on opposite end portions of the sheet-feed path 23 in the widthwise direction 13 thereof. The timing belt 41 is a belt having an endless loop-like shape with teeth in its inner surface and wound around the drive pulley 39 and the driven pulley 40. A carriage (CR) drive motor 311 as a first motor (see FIG. 5) is connected to a shaft of the drive pulley 39, and thus a drive power is transmitted from the CR drive motor 311 to the drive pulley 39. The drive power rotates the drive pulley 39, thereby circulating the timing belt 41.

The timing belt 41 is fixed to the carriage 31. The circulation of the timing belt 41 reciprocates the carriage 31 (and the recording head 30 mounted thereon) on the guide rails 35, 36. As described above, the CR drive motor 311 moves the carriage 31 via the belt drive mechanism 38.

An encoder strip 43 of a linear encoder 42 (see FIG. 5) is provided above the guide rail 36. The encoder strip 43 includes light transmitting portions each of which transmits light and light intercepting portions each of which intercepts light. The light transmitting portions and the light intercepting portions are alternately arranged at predetermined pitches so as to form a predetermined pattern. An optical sensor, not shown, is provided on the carriage 31 in order to detect the pattern of the encoder strip 43. A pulse signal is generated each time when the optical sensor has detected a mark of the encoder strip 43. This pulse signal is outputted to the controller 130. The controller 130 detects a position and a velocity of the image recording portion 24 in the main scanning direction on the basis of the pulse signal outputted from the linear encoder 42 and thereby controls the reciprocation of the carriage 31. The linear encoder 42 and the detection of the position and the velocity by the controller 130 function as a first detecting portion.

As shown in FIGS. 2 through 4, a platen 34 is disposed below the sheet-feed path 23 so as to be opposed to the recording head 30. The platen 34 has a width sufficiently wider than a width of a recording sheet of a maximum size that can be used in this MFD 1.

Figure 5:
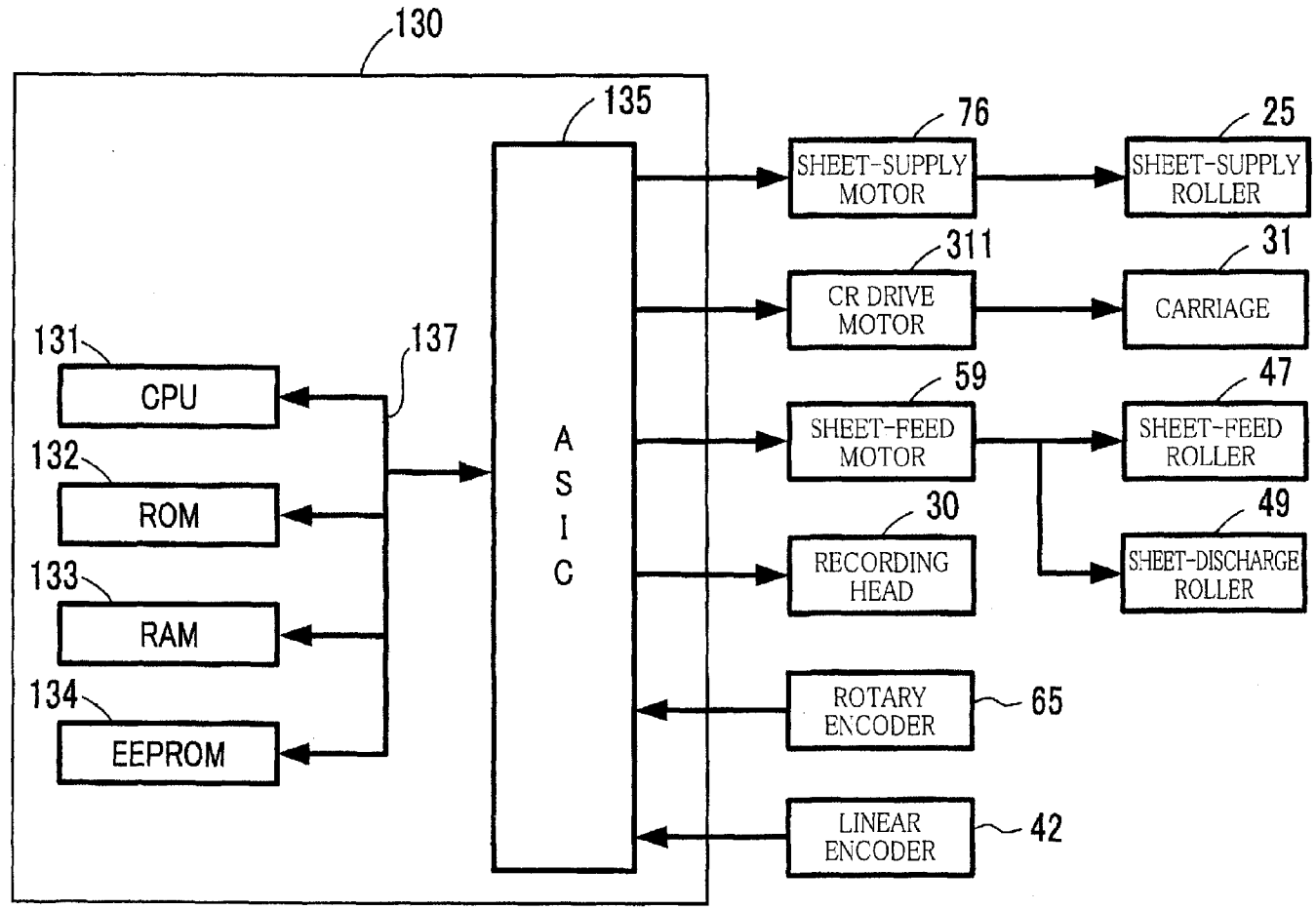
FIG. 5 is a block diagram showing a configuration of a controller 130.

As shown in FIG. 5, the controller 130 inputs a control signal to the recording head 30 via a drive circuit incorporated in an ASIC 135. The control signal is based on the recording data transmitted from the scanning section 3 or the external device, for example. In accordance with this control signal, the recording head 30 ejects the ink as a fine liquid droplet at each position during its reciprocation in the main scanning direction. That is, the carriage 31 is reciprocated in the main scanning direction along the guide rails 35, 36, whereby the recording head 30 reciprocated relative to the recording sheet records the image on the recording sheet being fed on the platen 34. That is, the recording head 30 ejects the ink droplets to record the image on the recording sheet while reciprocating in the main scanning direction.

As shown in FIGS. 2 and 4, the pair of sheet-feed rollers 54 are provided on an upstream side of the carriage 31 in the sheet-feed direction 15. The pair of sheet-feed rollers 54 is constituted by the sheet-feed roller 47 and the pinch roller 48 as a pair. When the sheet-feed roller 47 is forwardly rotated in a counterclockwise direction in FIG. 2, the recording sheet supplied from the sheet-supply tray 20 is nipped by the pair of sheet-feed rollers 54 and fed to a position below the carriage 31 located on a downstream side in the sheet-feed direction 15. That is, the sheet-feed roller 47 feeds or conveys the recording sheet relative to the carriage 31.

The pair of sheet-discharge rollers 55 constituted by the sheet-discharge roller 49 and the spur roller 50 are provided on a downstream side of the carriage 31 in the sheet-feed direction 15. The recording sheet on which the image has been recorded is nipped by the pair of sheet-discharge rollers 55 and fed or conveyed toward the sheet-discharge tray 21.

A gear, not shown, is fixed to one of opposite ends of the sheet-feed roller 47 in an axial direction thereof. With this gear is meshed an intermediate gear 57 which is also meshed with a gear fixed to a shaft of a sheet-feed motor 59 as a second motor. That is, the sheet-feed roller 47 is connected to the sheet-feed motor 59. A belt 58 is wound around an outer face of the sheet-discharge roller 49 at one of opposite end portions thereof in its axial direction. The belt 58 is wound also around the intermediate gear 57 and thus provided between the sheet-discharge roller 49 and the intermediate gear 57. As a result, the sheet-discharge roller 49 is connected to the sheet-feed motor 59. That is, the sheet-feed motor 59 rotates the sheet-feed roller 47 and the sheet-discharge roller 49 via a drive-power transmitting mechanism including the intermediate gear 57 and other transmitting components.

As shown in FIGS. 2 and 4, a rotary encoder 65 for detecting a rotation amount of the sheet-feed roller 47 is provided on an upstream side of the carriage 31 in the sheet-feed direction 15. The rotary encoder 65 is constituted by an optical sensor 60 and an encoder disc 51 provided on the same shaft as the sheet-feed roller 47 and rotatable with the sheet-feed roller 47. The encoder disc 51 includes light transmitting portions each of which transmits light and light intercepting portions each of which intercepts light. The light transmitting portions and the light intercepting portions are alternately arranged at predetermined pitches in a circumferential direction of the encoder disc 51 so as to form a predetermined pattern. During a rotation of the encoder disc 51 with the sheet-feed roller 47, a pulse signal is generated each time when the optical sensor 60 has detected a mark of the rotary encoder 65. This pulse signal is outputted to the controller 130. The controller 130 detects the rotation amount of the sheet-feed roller 47 on the basis of the pulse signal outputted from the rotary encoder 65 and thereby controls the rotation amount of the sheet-feed roller 47. The rotary encoder 65 and the detection of the rotation amount by the controller 130 function as a second detecting portion. In the present embodiment, the rotary encoder 65 is configured to detect the rotation amount of the sheet-feed roller 47 but may be configured to also detect a velocity of the sheet-feed roller 47 like the linear encoder 42.

As shown in FIG. 2, the recording sheet is intermittently fed on the platen 34 at a predetermined line feed pitch in the sheet-feed direction 15 by the sheet-feed roller 47 and the sheet-discharge roller 49. The carriage 31 is moved at each line feed, and the recording head 30 performs the image recording from a leading-end-side portion of the recording sheet.

<Controller 130>

There will be next explained a general configuration of the controller 130 with reference to FIG. 5.

The controller 130 is configured to control entire operations of the MFD 1. The controller 130 is constituted as a microcomputer mainly including a CPU 131, a ROM 132, a RAM 133, an EEPROM 134, and the ASIC 135. These are connected to one another via an internal bus 137.

The ROM 132 stores programs and so on for the CPU 131 to control various operations or processings (including a recording processing explained below) of the MFD 10. The RAM 133 is used as a storage area for temporarily storing data, signals, and so on used when the CPU 131 performs the above-described programs or used as a working area for a data processing. The EEPROM 134 stores settings and flags and the like which are to be kept also after the MDF 10 is turned off.

The sheet-supply motor 76, the CR drive motor 311, the sheet-feed motor 59, and the recording head 30 are connected to the ASIC 135. Into the ASIC 135 is incorporated drive circuits for controlling the respective motors. When a drive signal for rotating one of the motors has been inputted from the CPU 131 to a corresponding one of the drive circuits, a drive current corresponding to the drive signal is outputted from the drive circuit to the corresponding motor. As a result, the corresponding motor is rotated forwardly or reversely at a predetermined rotation speed. That is, the controller 130 controls the sheet-supply motor 76, the CR drive motor 311, and the sheet-feed motor 59.

Further, the pulse signals outputted from the rotary encoder 65 and the linear encoder 42 are inputted into the ASIC 135. The controller 130 calculates the rotation amount of the sheet-feed roller 47 on the basis of the pulse signal outputted from the rotary encoder 65 and outputs a drive signal to the drive circuit for rotating the sheet-feed motor 59 such that the calculated rotation amount coincides with a target rotation amount. That is, the controller 130 controls the rotation amount of the sheet-feed roller 47 on the basis of the pulse signal outputted from the rotary encoder 65. Further, the controller 130 calculates the velocity and the position of the carriage 31 on the basis of the pulse signal outputted from the linear encoder 42 and outputs a drive signal to the drive circuit for rotating the CR drive motor 311 such that the calculated velocity or the position coincides with a target velocity or a target position. That is, the controller 130 controls the reciprocation of the carriage 31 on the basis of the pulse signal outputted from the linear encoder 42.

<Recording Processing>

Figure 6:
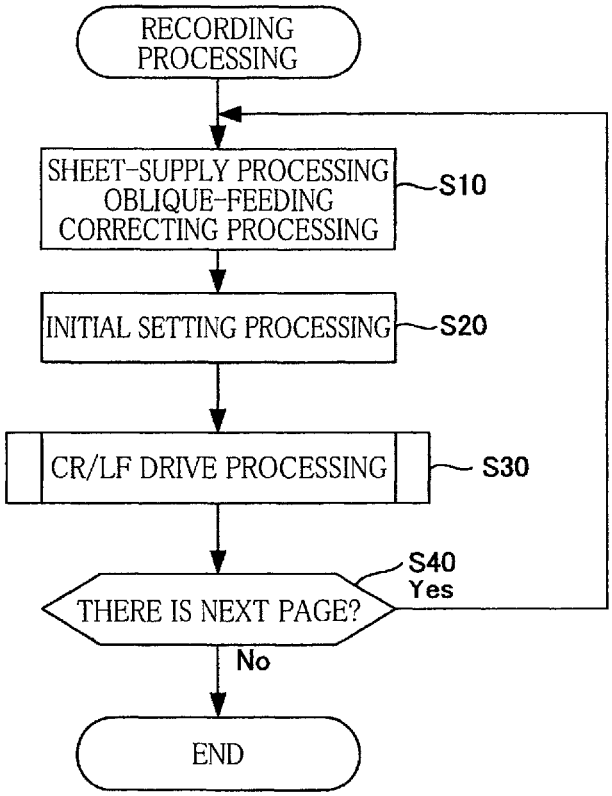
FIG. 6 is a flow-chart showing an example of a procedure of a recording processing executed by the controller 130.

There will be next explained the recording processing with reference to FIG. 6. The recording processing is executed by the controller 130 for supplying the recording sheet and recording the image on the recording sheet in the printing section 2. It is noted that processings in FIGS. 6 and 7 are executed by the controller 130 unless otherwise specified.

Initially in S10, when a command for the image recording has been inputted from the external device or the operational panel 9 into the MFD 1, the controller 130 drives the sheet-supply motor 76 to rotate the sheet-supply roller 25, thereby supplying the recording sheet accommodated on the sheet-supply tray 20 toward the pair of sheet-feed rollers 54. In this time, the sheet-feed roller 47 is in a stopped state and the sheet-supply roller 25 supplies the recording sheet by a distance longer than a distance from a leading end of the accommodated recording sheet to the nipping position of the pair of sheet-feed rollers 54. The recording sheet is fed by the longer distance, thereby executing a processing for correcting an oblique feeding of the recording sheet. Then in S20, the controller 130 executes an initial setting processing for feeding the recording sheet to a recording position on the basis of a margin of the sheet stored in the recording data. Then in S30, the controller 130 controls the drives of the carriage (CR) 31 and the sheet-feed roller 47 (hereinafter may be referred to as "a CR/LF drive processing" which will be explained with reference to FIG. 7. Then in S40, the controller 130 judges whether or not there is recording data based on which the image recording is to be performed on the next sheet after the image recording on the current sheet has been finished Where the controller 130 has judged that there is such recording data (S40: Yes), this recording processing returns to S10 in which a next sheet supply is performed. On the other hand, the controller 130 has judged that there is no such recording data (S40: No), this recording processing is finished.

Figure 7:
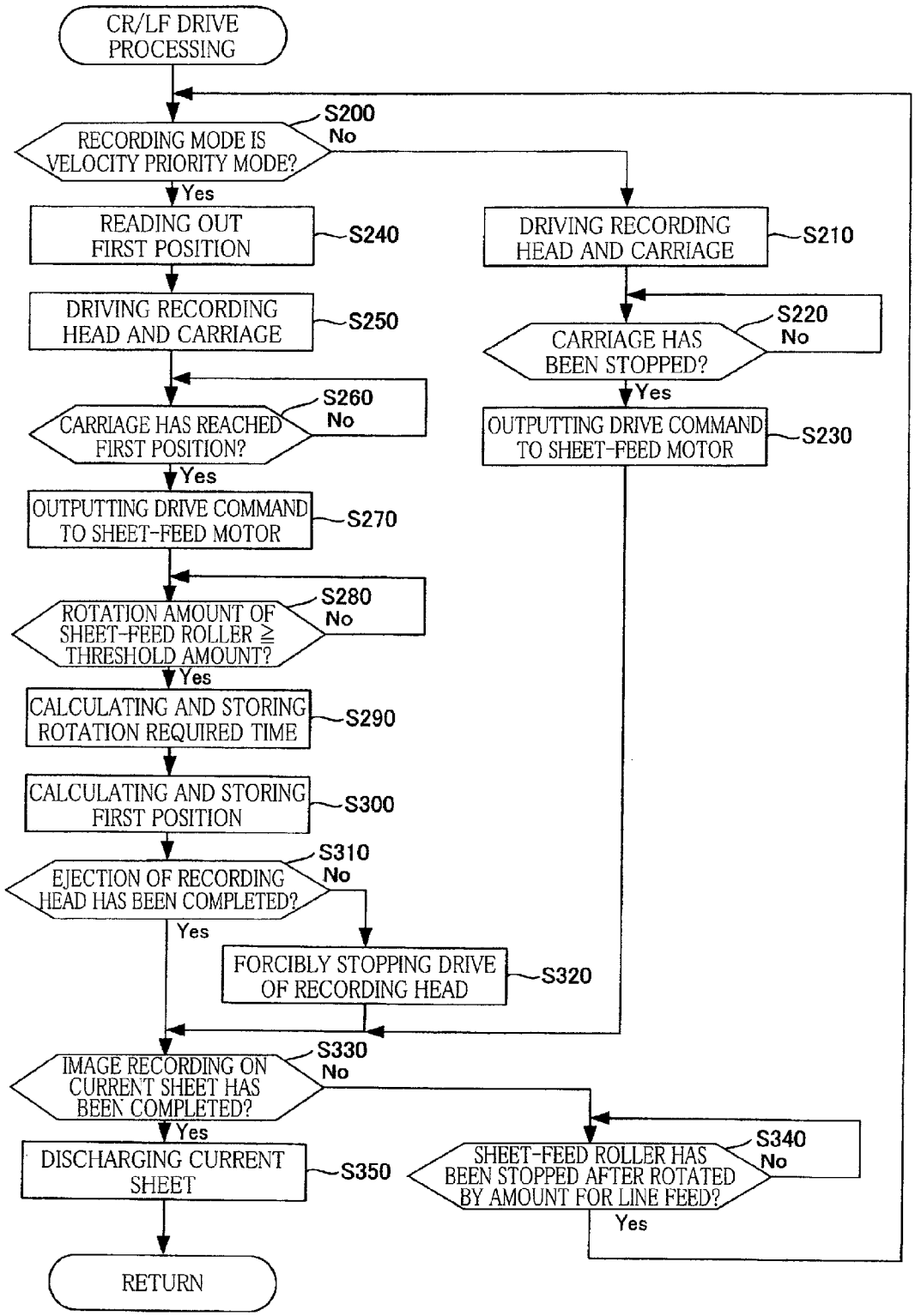
FIG. 7 is a flow-chart showing an example of a procedure of a CR/LF drive processing executed by the controller 130.

There will be next explained the CR/LF drive processing with reference to FIG. 7.

Figure 8A:
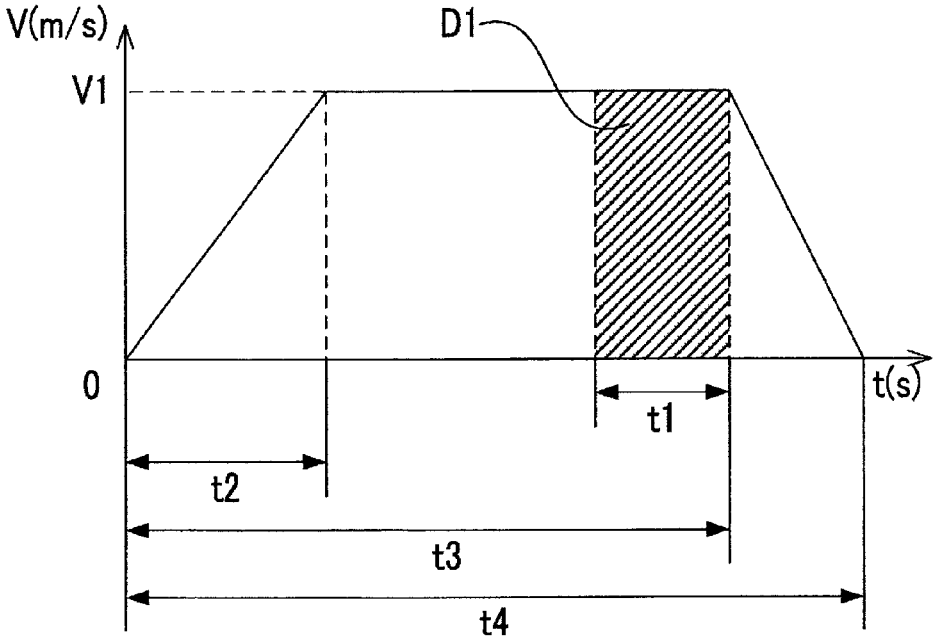
FIGS. 8A and 8B are views each showing a characteristic of a velocity V of an image recording portion 24 with respect to an elapsed time t elapsed from an output of a drive command to a CR drive motor 311, FIG. 8A showing a case where the image recording portion 24 is moved at a constant velocity upon a start and an end of an ejection of liquid droplets, and FIG. 8B showing a case where the image recording portion 24 is accelerated or decelerated upon a start or an end of an ejection of liquid droplets.
Figure 8B:
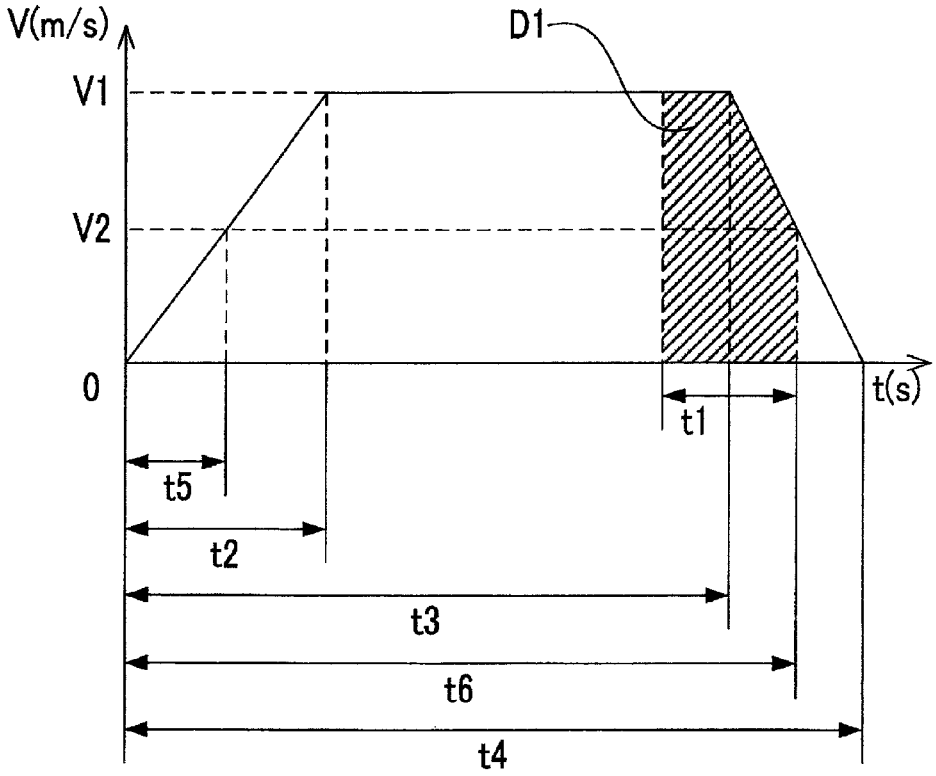

As a precondition, velocity information used for the CR/LF drive processing is stored in a first storage portion such as the ROM 132 or the EEPROM 134. Here, the velocity information is predetermined target velocity information from a start to an end of the movement of the carriage 31 in the main scanning direction when the carriage 31 is driven by the CR drive motor 311. That is, as shown in FIGS. 8A and 8B, the velocity information is information about a velocity V of the carriage 31 with respect to an elapsed time t elapsed from the output of the drive command to the CR drive motor 311 and is data sets satisfying a relationship between the elapsed time t and the velocity V.

The velocity information in the present embodiment has the following characteristics. That is, when the drive command has been outputted to the CR drive motor 311, the carriage 31 starts to move while being accelerated at a specific rate. When the velocity of the carriage 31 has reached V1 after t2 seconds from the start, the carriage 31 starts to move at a constant velocity. After t3 seconds, the carriage 31 starts to be decelerated at a specific rate. After t4 seconds, the velocity of the carriage 31 becomes zero and the carriage 31 stops moving.

Initially in S200, the controller 130 executes a processing for determining whether or not processings corresponding to the present invention are executed on the basis of recording conditions upon the image recording on the recording sheet.

The recording conditions include a resolution and a recording velocity of the image, for example. These recording conditions may be designated by a user or on the basis of the recording data. In the present embodiment, a recording mode of the image includes: a velocity priority mode in which the image recording is performed at a higher velocity with a lower image quality; and an image-quality priority mode in which the image recording is performed at a lower velocity with a higher image quality than the velocity priority mode. The velocity priority mode is used for a text recording and the image-quality priority mode is used for a photo recording, for example. In the judgment in S200, the controller 130 judges whether the recording mode is the velocity priority mode or not. Where the controller 130 has judged that the recording mode is the image-quality priority mode (S200: No), the controller 130 determines not to execute the processings corresponding to the present invention. Where the controller 130 has judged that the recording mode is the velocity priority mode (S200: Yes), the controller 130 determines to execute the processings corresponding to the present invention.

Where the controller 130 has judged that the recording mode is the image-quality priority mode (S200: No), the controller 130 in S210 drives the CR drive motor 311 and the recording head 30 to perform the image recording. That is, the controller 130 drives the recording head 30 on the basis of the recording data so as for the recording head 30 to eject the liquid droplets during a single movement of the carriage 31 in the main scanning direction, that is, for a duration that the carriage 31 in a stopped state starts to move and then stops at the target position. Then in S220, the controller 130 judges whether the carriage 31 has been stopped or not. Where the controller 130 has judged that the carriage 31 has been stopped (S220: Yes), the controller 130 in S230 outputs the drive command to the sheet-feed motor 59 to drive the sheet-feed motor 59 so as to rotate the sheet-feed roller 47.

Then in S330, the controller 130 judges whether the image recording on the current recording sheet has been completed or not. Where the controller 130 has judged that the image recording on the current recording sheet has not been completed (S330: No), the controller 130 in S340 stops the sheet-feed roller 47 after the sheet-feed roller 47 has been rotated by an amount for the recording sheet to be fed by the predetermined line feed pitch. Then, after the judgment of S200 (S200: No), the controller 130 in S210 drives the CR drive motor 311 and the recording head 30 again. Then, after the processings of S220 and S230, where the controller 130 has made an affirmative decision in S330 (S330: Yes), that is, where the controller 130 has judged that the image recording on the current recording sheet has been completed, the controller 130 in S350 drives the sheet-feed motor 59 to rotate the sheet-feed roller 47 and the sheet-discharge roller 49, whereby the recording sheet is discharged onto the sheet-discharge tray 21 by the pair of sheet-discharge rollers 55. Then, this processing goes to the processing of S40 in the recording processing shown in FIG. 6. As described above, in the case of the image-quality priority mode, the processing for driving the sheet-feed motor 59 to rotate the sheet-feed roller 47 after the carriage 31 has been stopped and the processing for driving the CR drive motor 311 to move the carriage 31 after the sheet-feed roller 47 has been stopped are repeatedly executed until the image has been completely recorded on the recording sheet.

On the other hand, where the controller 130 has judged that the recording mode is the velocity priority mode (S200: Yes), the controller 130 in S240 reads out a first position from the ROM 132 or the RAM 133. The first position is a position in the main scanning direction located on an upstream side (a recording-start side) of a second position by a specific distance in the direction of the recording movement of the carriage 31, and the second position is a position of the carriage 31 at a point in time when the recording head 30 has completed the ejection of the liquid droplets for the recording movement. This specific distance is set as a distance by which the carriage 31 is moved during a rotation required time or period from the output of the drive command to the sheet-feed roller 47 to a feeding of the recording sheet by a specific distance. More specifically, the rotation required time is a total period of (a) a delayed time as a period from a point when the drive command has been outputted to the sheet-feed motor 59 to a point when the sheet-feed roller 47 has actually started to be rotated and (b) a period from a point when the sheet-feed roller 47 has actually started to be rotated to a point when the sheet-feed roller 47 has been actually rotated by a specific threshold amount. Here, the first position is a value set in advance and stored in, e.g., the ROM 132 or a value calculated in S300 and stored in the RAM 133 as will be explained below. For example, the value calculated in S300 and stored in the RAM 133 is a value calculated upon a previous line feed of the recording sheet at the predetermined line feed pitch, i.e., a value calculated upon a line feed that has been most recently performed. That is, in an initial image recording for the first line of the recording sheet, the controller 130 uses the first position stored in advance in the ROM 132 to control a timing of the output of the drive command to the sheet-feed motor 59. In a second or subsequent image recording, the controller 130 uses the first position calculated in a previous recording for the previous line and stored in the RAM 133 to control the timing of the output of the drive command to the sheet-feed motor 59.

Then in S250, the controller 130 drives the CR drive motor 311 and the recording head 30. As a result, the carriage 31 starts to move in the main scanning direction, and the recording head 30 starts to eject the liquid droplets onto the recording sheet.

Then in S260, the controller 130 judges whether the carriage 31 having started to move has reached the first position read out in S240 or not, that is, the controller 130 judges whether the carriage 31 has reached the first position on the basis of the pulse signal outputted from the linear encoder 42. Where the controller 130 has judged that the carriage 31 has reached the first position (S260: Yes), the controller 130 in S270 outputs the drive command to the sheet-feed motor 59, thereby driving the sheet-feed motor 59 in accordance with the drive command to rotate the sheet-feed roller 47. Further, a timer, not shown, starts to count a time from a point in time when the drive command for the sheet-feed motor 59 has been outputted.

Where the sheet-feed roller 47 has started to be rotated, the controller 130 judges in S280 whether the rotation amount of the sheet-feed roller 47 has reached the preset threshold amount from the start of the rotation. The threshold amount is represented as a count number of the rotary encoder 65, for example, and stored in the ROM 132. For example, the count number is one. It is noted that the count number of the rotary encoder 65 is a pulse number of the pulse signals outputted from the rotary encoder 65. In the present embodiment, the preset threshold of the sheet-feed roller 47 is set as the rotation amount of the sheet-feed roller 47 at a point in time when one pulse is outputted from the rotary encoder 65, but the preset threshold of the sheet-feed roller 47 may be set as a rotational amount of the sheet-feed roller 47 at a point in time when a preset number (at least one) of pulses is outputted from the rotary encoder 65.

Where the controller 130 has judged that the rotation amount of the sheet-feed roller 47 has reached the threshold amount (S280: Yes), the controller 130 executes processing of S290-S310 which will be hereinafter explained in detail.

In S290, the controller 130 uses the timer to calculate the rotation required time which is a period after the output of the drive command to the sheet-feed motor 59 and before the rotation amount of the sheet-feed roller 47 has reached the threshold amount, and the controller 130 stores the calculated rotation required time into the RAM 133.

It is noted that the sheet-feed roller 47 repeats the stop (S340) and the rotation (S270) until the completion of the image recording on the recording sheet. That is, in the present embodiment, the calculation of the rotation required time is performed each time when the sheet-feed roller 47 is rotated. It is noted that the MFD 1 may be configured such that the rotation required time is not calculated each time when the sheet-feed roller 47 is rotated. For example, the MFD 1 may be configured such that the rotation required time is calculated every three rotations of the sheet-feed roller 47. In this case, the controller 130 calculates the first position on the basis of one of the rotation required times that has been most recently calculated.

In S300, the controller 130 calculates the first position on the basis of the velocity information stored in the ROM 132 and the rotation required time calculated in S290. The controller 130 then stores the calculated first position into the RAM 133. The first position is the position of the carriage 31 at a point in time earlier by the rotation required time calculated in S290 than a point in time when the carriage 31 is positioned at the second position at which the ejection of the liquid droplets has been completed in the movement of the carriage 31 in the main scanning direction.

The first position is calculated by obtaining an area (a size) of a hatched area in the velocity information shown in FIGS. 8A and 8B.

For example, FIG. 8A shows a case where the ejection of the liquid droplets is started at a time when the state of the movement of the carriage 31 (the image recording portion 24) is changed from the acceleration state to the constant velocity state (i.e., t2 seconds after the output of the drive command to the CR drive motor 311), and the ejection of the liquid droplets is completed when the state of the movement of the carriage 31 is changed from the constant velocity state to the deceleration state (i.e., t3 seconds after the output of the drive command to the CR drive motor 311). Further, a length of time from the output of the drive command to the sheet-feed motor 59 to the point when the rotation amount of the sheet-feed roller 47 has reached the threshold amount is defined as t1, that is, t1 corresponds to the rotation required time. In this case, an area of a rectangle whose vertical length is the velocity V1 as the constant velocity and horizontal width is the rotation required time t1 represents a distance D1 from the second position to the first position. Accordingly, the first position is set at a position nearer to the start position of the carriage 31 than the second position by the distance D1.

Further, FIG. 8B shows another case where the ejection of the liquid droplets is started during the acceleration state of the carriage 31 (e.g., t5 seconds after the output of the drive command to the CR drive motor 311), and the ejection of the liquid droplets is completed during the deceleration state of the carriage 31 (e.g., t6 seconds after the output of the drive command to the CR drive motor 311). Further, a length of time from the output of the drive command to the sheet-feed motor 59 to the point when the rotation amount of the sheet-feed roller 47 has reached the threshold amount is defined as t1 as in the case in FIG. 8A. In this case, a total area of (a) an area of a trapezoid whose top side is the velocity V2 after t6 seconds, bottom side is the velocity V1 as the constant velocity, and height is the rotation required time t1 and (b) an area of a triangle whose base is "(t1−t6−t3)" and height is "(V1−V2)" represents a distance D1 from the second position to the first position. Accordingly, the first position is set at a position nearer to the start position of the carriage 31 than the second position by the distance D1. It is noted that this calculation method of the first position is not limited to the method explained above. That is, any method can be used as long as the first position is calculated in each line of the recording sheet on the basis of the rotation required time and the target velocity of the carriage 31.

The second position is a position determined in a design of the MFD 1 and also determined by the recording data. The recording data includes a position at which the ejection of the recording head 30 is completed, that is, the first position is a position set in each line of the recording sheet on the basis of the recording data. Thus, the first position can be calculated as a position distant from the second position by the distance D1 in a direction opposite to a direction in which the carriage 31 is moved toward the second position in order to complete the image recording.

It is noted that, in the present embodiment, the controller 130 executes the processing for calculating the first position each time when the sheet-feed roller 47 is rotated, like the calculation of the rotation required time.

In S310, the controller 130 judges whether or not the ejection of the liquid droplets from the recording head 30 has been completed at the time when the controller 130 has made the affirmative decision in S280. Where the controller 130 has judged that the ejection of the liquid droplets has not been completed (S310: No) in the case where the controller 130 has made the affirmative decision in S280, the controller 130 in S320 forcibly stops the drive of the recording head 30. That is, the controller 130 forcibly stops the ejection of the liquid droplets where the ejection of the liquid droplets by the recording head 30 has not been completed at the timing when the sheet-feed roller 47 has been rotated by the threshold amount by the drive command outputted by the controller 130.

Where the controller 130 has judged that the ejection of the liquid droplets has been completed (S310: Yes), the controller 130 judges in S330 whether the image recording on the current recording sheet has been completed or not. That is, the controller 130 judges whether there is any image or character to be recorded on a next line on the basis of the recording data. Where the controller 130 has judged that the image recording on the current recording sheet has not been completed (S330: No), the controller 130 in S340 stops the sheet-feed roller 47 after the sheet-feed roller 47 has been rotated by the amount for feeding the recording sheet by the predetermined line feed pitch. Then in S240, the controller 130 reads out the first position again. It is noted that the controller 130 may perform the read-out of the first position and the drive of the CR drive motor 311 during the rotation of the sheet-feed roller 47. Where the controller 130 has judged that the image recording on the current recording sheet has been completed (S330: Yes), the controller 130 in S350 rotates the sheet-feed roller 47 and the sheet-discharge roller 49 to discharge the recording sheet onto the sheet-discharge tray 21. As a result, the image recording on the single recording sheet has been completed. Then, this processing goes to the processing of S40 in the recording processing shown in FIG. 6. Where the controller 130 judges whether or not there is recording data based on which the image recording is to be performed on a next recording sheet (S40: Yes), the controller 130 executes the processing in S10 for supplying the recording sheet. Where there is no recording data based on which the image recording is to be performed on a next recording sheet (S40: No), the controller 130 completes the recording processing.

In view of the above, the controller 130 can be considered to include a position storing section configured to store the first position, and this position storing section can be considered to perform the processing in S300. Further, the controller 130 can be considered to include a drive command outputting section configured to output the drive command to the sheet-feed motor 59 when the position of the image recording portion 24 has reached the first position, and this drive command outputting section can be considered to perform the processing in S270. Further, the controller 130 can be considered to include a position calculating section configured to calculate the first position on the basis of the rotation required time and the velocity information, and this position calculating section can be considered to perform the processing in S300.

Further, the controller 130 can be considered to include a rotation-required-period calculating section configured to calculate the rotation required time upon each rotation of the sheet-feed roller 47, and this rotation-required-period calculating section can be considered to perform the processing in S290. Further, the controller 130 can be considered to include an ejection stopping section configured to forcibly stop the ejection of the liquid droplets where the ejection has not been completed at the point when the sheet-feed roller 47 has been rotated by the threshold amount, and this ejection stopping section can be considered to perform the processing in S320. Further, the controller 130 can be considered to include a determination section configured to determine whether or not the drive command outputting section outputs the drive command on the basis of the recording condition, and this determination section can be considered to perform the processing in S200.

Effects of Embodiment

In the present embodiment, the controller 130 stores the first position of the carriage 31 at the point earlier by the rotation required time than the first point at which the ejection of the liquid droplets is completed in the movement of the carriage 31 in the main scanning direction, on the basis of the rotation required time from the output of the drive command to the sheet-feed motor 59 to the point when the sheet-feed roller 47 has been actually rotated by the specific amount. The controller 130 outputs the drive command to the sheet-feed motor 59 when the carriage 31 has reached the first position. As a result, the rotation required time coincides with a period for the movement of the image recording portion 24. Thus, the carriage 31 reaches the second position (that is, the image recoding is completed) at the same time as the sheet-feed roller 47 has been rotated by the specific amount. Accordingly, in the present embodiment, a length of time required for the image recording can be made shorter by eliminating an affect of the delay from the drive command to the sheet-feed motor 59 to the point when the sheet-feed roller 47 has been actually rotated by the specific amount.

Further, in the present embodiment, since the controller 130 calculates the first position on the basis of the velocity information from the start to the end of the movement of the carriage 31, the first position is set as a position suitable for the operation of the carriage 31.

Further, in the present embodiment, since the calculation of the first position is performed each time when the sheet-feed motor 59 is driven, the first position reflects the rotation required time in the most recent drive. As a result, it is possible to appropriately deal with a variation of the rotation required time caused by a variation of a load during the operation of the MFD 1 or a deterioration of the motor, for example.

Further, the MFD 1 may be set such that the above-described controls are not performed in the image recording in the image-quality priority mode but performed only in the image recording in the velocity priority mode, for example, whereby the length of time required for the image recording can be shortened in the image recording in a suitable recording mode.

Further, since the controller 130 stops the ejection of the liquid droplets at the time when the rotation amount of the sheet-feed roller 47 has reached the threshold amount, it is possible to prevent the image recording from being performed during the feeding of the recording sheet, thereby suppressing a deterioration of the image quality.

First Modification of Embodiment

In the above-described embodiment, the rotation required time and the first position are calculated by the controller 130, but the present invention is not limited to this configuration. That is, the rotation required time and the first position may be set in advance. For example, respective preset values of the rotation required time and the first position may be stored in the ROM 132 like the velocity information. As a result, it is possible to eliminate a need to calculate the rotation required time and the first position, thereby shortening a processing time.

Second Modification of Embodiment

In the above-described embodiment, the rotation required time is calculated each time when the sheet-feed roller 47 is rotated, and the first position is calculated on the basis of this calculated rotation required time, but the present invention is not limited to this configuration. That is, the MFD 1 may be configured such that the rotation required time calculated each time when the sheet-feed roller 47 is rotated (that is, the sheet-feed roller 47 intermittently driven is rotated in S270 in FIG. 7) is stored into the RAM 133, and the controller 130 calculates the first position on the basis of a plurality of the rotation required times stored in the RAM 133.

For example, the controller 130 may calculate the first position on the basis of an average value (time) of the plurality of the rotation required times stored in the RAM 133 in S290 in FIG. 6. Where the MFD 1 is configured in this manner, the number of the rotation required times used for obtaining the average value is, e.g., five from the most recent rotation of the sheet-feed roller 47 to the rotation thereof made at predetermined times before (e.g., five times before).

For example, a backlash and a friction of a connecting portion of gears between the sheet-feed motor 59 and the sheet-feed roller 47 may vary according to various factors such as an environment and an operating time of the MFD 1. In this case, the rotation required time may vary accordingly. As a result, a variation may be caused in the rotation required time and eventually in the first position, making it impossible for the controller 130 to output the drive command at an appropriate timing. However, in this second modification, since the controller 130 calculates the first position of the carriage 31 on the basis of the average value of the rotation required times of the plurality of the rotations of the sheet-feed roller 47, an affect of the variation of the rotation required time can be reduced upon the calculation of the first position.

Instead of using the average value for the calculation of the first position, the controller 130 may use the smallest value (the shortest time) of the plurality of the rotation required times stored in a second storage portion such as the RAM 133 in S290 in FIG. 6. That is, the controller 130 may calculate the first position on the basis of the smallest value of the plurality of the rotation required times. Where the MFD 1 is configured in this manner, the number of the rotation required times used for selecting the smallest value is, e.g., five from the most recent rotation of the sheet-feed roller 47 to the rotation thereof made at predetermined times before (e.g., five times before) as in the above-described case.

As described above, the rotation required time and the first position may vary according to the various factors such as the environment and the operating time of the MFD 1. However, this MFD 1 is configured to calculate the first position on the basis of the longest one of the rotation required times of the plurality of the drives. Accordingly, even if the rotation required time has varied due to an age deterioration, it is possible to prevent that the sheet-feed roller 47 is rotated during the image recording by the recording head 30 mounted on the carriage 31 and thereby the recording sheet is fed.

Instead of obtaining the average value and selecting the smallest value, the controller 130 may execute a processing for predicting the smallest value among the plurality of the rotation required times and then calculate the first position on the basis of the smallest value predicted by the controller 130.

The velocity of the motor changes periodically due to a cogging, etc., and accordingly the rotation required time also changes periodically. Hereinafter there will be explained an example of the prediction of the controller 130, assuming that the number of the rotation required times used for the prediction of the smallest value is three from the most recent rotation of the sheet-feed roller 47 to the rotation thereof made at three times before. Where a velocity of the rotation three times before is defined as V3, a velocity of the rotation two times before is defined as V4 which is lower than V3, and a velocity of the most recent rotation is defined as V5 which is lower than V4, the controller 130 predicts a velocity V6 lower than V5 as the smallest value on the basis of a difference between V3 and V4 and a difference V4 and V5. Where the velocity of the rotation three times before is V3, the velocity of the rotation two times before is V4 lower than V3, and the velocity of the most recent rotation is V5 higher than V4, the controller 130 predicts V4 as the smallest value.

Where this MFD 1 is configured in this manner, the controller 130 can predict the smallest value of the rotation required times, making it possible to set the first position more appropriately. It is noted that, in view of the above, the controller 130 can be considered to include a predicting section configured to predict the smallest value of the plurality of the rotation required times, and this predicting section can be considered to perform the processing in S300.

Third Modification of Embodiment

The MFD 1 may be configured such that the ROM 132 or the like stores therein a plurality of threshold amounts (threshold values) corresponding to the recording conditions of the image recording portion 24.

For example, the RAM 133, the ROM 132, or the EEPROM 134 may store therein the threshold amounts (two threshold amount in this example) respectively corresponding to the velocity priority mode and the image-quality priority mode. It is noted that the controller 130 may store the threshold amounts in advance into a third storage portion such as the ROM 132 or the EEPROM 134 and may store the threshold amounts into the RAM 133 or the EEPROM 134 upon the execution of the recording processing.

Where the controller 130 has a plurality of threshold amounts respectively corresponding to the recording conditions, it is possible to set the rotation required time and the first position more appropriately or precisely. Accordingly, the length of time required for the image recording can be further shortened. For example, in the case of the velocity priority mode, where the recording data consists of only text data or where the recording data permits an image deviation to a certain extent (for example, where the recording data is data based on which an image having a lower resolution is recorded on the recording sheet), a large threshold amount is preferably used for reducing the length of time required for the image recording. In contrast, in the case of the image recording in which a priority is given to the velocity and the image deviation is suppressed to a minimum extent, a small threshold amount is preferably used.

Fourth Modification of Embodiment

In the above-described embodiment, the controller 130 calculates the first position on the basis of the calculated rotation required time, but the present invention is not limited to this configuration. That is, the MFD 1 may be configured such that the controller 130 counts a distance of the movement of the carriage 31 from the output of the drive command to the sheet-feed motor 59 to the rotation of the sheet-feed roller 47 by the threshold amount and then the controller 130 obtains the first position on the basis of the counted distance. Where the image recording is performed while the carriage 31 is moved at the constant velocity, that is, where an image area is included in a constant-velocity area of the carriage 31, a distance of the movement of the carriage 31 from the first position to the second position is the same in the recording before a line feed and in the recording after the line feed. Thus, the first position can be calculated only by counting the distance of the movement of the carriage 31 without calculating the rotation required time. It is noted that where the velocity information of the carriage 31 is changed such that a changing rate of the velocity is constant in a previous recording area and in a current recording area, the first position can be calculated by the above-mentioned calculating method even where the image recording is performed in an acceleration area or a deceleration area.

What is claimed is:

1. An image recording apparatus comprising:

a recording portion configured to eject liquid droplets to record an image on a recording medium while being moved in a second direction intersecting a first direction in which the recording medium is fed;

a feeding roller configured to feed the recording medium toward the recording portion;

a first detecting portion configured to detect a position and a velocity of the recording portion in the second direction;

a second detecting portion configured to detect a rotation amount of the feeding roller;

a first motor configured to move the recording portion;

a second motor configured to rotate the feeding roller; and a controller configured to control the movement of the recording portion by outputting a drive command to the first motor and configured to control the rotation of the feeding roller by outputting a drive command to the second motor, the controller including:

a position storing section configured to store a first position which is a position of the recording portion, in a single movement of the recording portion, at a point in time earlier by a rotation required period than a point in time when the recording portion is positioned at a second position at which the ejection of the liquid droplets has been completed in the single movement of the recording portion, the rotation required period being a period from a point in time when the drive command is outputted to the second motor to a point in time when an amount of the rotation of the feeding roller reaches a preset threshold amount; and a drive command outputting section configured to output the drive command to the second motor when the position of the recording portion which has been detected by the first detecting portion has reached the first position.

2. The image recording apparatus according to claim 1, wherein the second detecting portion is configured to detect the rotation amount of the feeding roller on the basis of the number of pulse signals generated by the rotation of the feeding roller, and wherein the position storing section is configured to set the threshold amount such that the number of the pulse signals detected by the second detecting portion after the drive command is outputted to the second motor by the drive command outputting section is a preset number.

3. The image recording apparatus according to claim 1, wherein the preset number is one.

4. The image recording apparatus according to claim 1, wherein the controller further includes:

a first storage portion configured to store therein preset velocity information about a velocity from a start to an end of the single movement of the recording portion while the recording portion is moved in the second direction by the first motor; and a position calculating section configured to calculate the first position on the basis of the rotation required period and the velocity information stored in the first storage portion, and wherein the position storing section is configured to store the calculated first position calculated by the position calculating section.

5. The image recording apparatus according to claim 4, wherein the controller further includes a rotation-required-period calculating section configured to calculate the rotation required period in each rotation of the feeding roller, and wherein the position calculating section is configured to calculate the first position in said each rotation of the feeding roller on the basis of the rotation required period calculated by the rotation-required-period calculating section upon each rotation of the feeding roller.

6. The image recording apparatus according to claim 4, wherein the controller further includes:

a rotation-required-period calculating section configured to calculate the rotation required period in each rotation of the feeding roller; and a second storage portion configured to store therein a plurality of the rotation required periods calculated by the rotation-required-period calculating section, and wherein the position calculating section is configured to calculate the first position in said each rotation of the feeding roller on the basis of an average value of the plurality of the rotation required periods stored in the second storage portion.

7. The image recording apparatus according to claim 4, wherein the controller further includes:

a rotation-required-period calculating section configured to calculate the rotation required period in each rotation of the feeding roller; and a second storage portion configured to store therein a plurality of the rotation required periods calculated by the rotation-required-period calculating section, and wherein the position calculating section is configured to calculate the first position in said each rotation of the feeding roller on the basis of a smallest value of the plurality of the rotation required periods stored in the second storage portion.

8. The image recording apparatus according to claim 4, wherein the controller further includes:

a rotation-required-period calculating section configured to calculate the rotation required period in each rotation of the feeding roller;

a second storage portion configured to store therein a plurality of the rotation required periods calculated by the rotation-required-period calculating section; and a predicting section configured to predict a smallest value of the plurality of the rotation required periods stored in the second storage portion, and wherein the position calculating section is configured to calculate the first position in said each rotation of the feeding roller on the basis of the smallest value of the rotation required periods which has been predicted by the predicting section.

9. The image recording apparatus according to claim 1, wherein the controller further includes an ejection stopping section configured to forcibly stop the ejection of the liquid droplets by the recording portion where the ejection of the liquid droplets by the recording portion has not been completed at a point in time when the amount of the rotation of the feeding roller reaches the threshold amount by the drive command outputted by the drive command outputting section.

10. The image recording apparatus according to claim 1, wherein the controller further includes a determination section configured to determine whether or not the drive command outputting section outputs the drive command on the basis of a recording condition in which the recording portion performs image recording.

11. The image recording apparatus according to claim 1, wherein the controller further includes a threshold-amount storage portion configured to store therein a plurality of the threshold amounts corresponding to at least one recording condition in which the recording portion performs image recording.

12. An image recording method applied to an image recording apparatus including:

a recording portion configured to eject liquid droplets to record an image on a recording medium while being moved in a second direction intersecting a first direction in which the recording medium is fed;

a feeding roller configured to feed the recording medium toward the recording portion;

a first detecting portion configured to detect a position and a velocity of the recording portion in the second direction;

a second detecting portion configured to detect a rotation amount of the feeding roller;

a first motor configured to move the recording portion; and a second motor configured to rotate the feeding roller, the image recording method comprising:

storing a first position which is a position of the recording portion, in a single movement of the recording portion, at a point in time earlier by a rotation required period than a point in time when the recording portion is positioned at a second position at which the ejection of the liquid droplets has been completed in the single movement of the recording portion, the rotation required period being a period from a point in time when the drive command is outputted to the second motor to a point in time when an amount of the rotation of the feeding roller reaches a preset threshold amount;

outputting the drive command to the second motor when the position of the recording portion which has been detected by the first detecting portion has reached the first position; and controlling a drive of the second motor on the basis of the drive command to rotate the feeding roller.

* * * * *